US006855064B2

(12) United States Patent
Sundahl

(10) Patent No.: US 6,855,064 B2
(45) Date of Patent: Feb. 15, 2005

(54) ARRANGEMENT FOR A PLAYGROUND FOR CHILDREN

(75) Inventor: Frank Sundahl, Vejle (DK)

(73) Assignee: Dansk Yacht-Fiber A/S, Kolding (DK)

( * ) Notice: Subject to any disclaimer, the term of this patent is extended or adjusted under 35 U.S.C. 154(b) by 0 days.

(21) Appl. No.: 10/614,798

(22) Filed: Jul. 9, 2003

(65) Prior Publication Data

US 2004/0077421 A1 Apr. 22, 2004

(30) Foreign Application Priority Data

Jul. 17, 2002 (DK) ..... BA 2002 00221 U

(51) Int. Cl.[7] ..... A63G 21/00
(52) U.S. Cl. ..... 472/116; 472/117; 482/35
(58) Field of Search ..... 472/116, 117, 472/128; 482/35, 36; D21/820, 825, 826, 827

(56) References Cited

U.S. PATENT DOCUMENTS

| | | | | | |
|---|---|---|---|---|---|
| 830,853 | A | * | 9/1906 | Thompson | 472/116 |
| 861,919 | A | * | 7/1907 | Thompson | 472/116 |
| D223,460 | S | * | 4/1972 | Ahrens | D21/820 |
| 4,369,965 | A | * | 1/1983 | Ahrens | 482/35 |
| 4,546,965 | A | * | 10/1985 | Baxter et al. | 482/35 |
| D316,134 | S | * | 4/1991 | Gianacakos | D21/244 |
| 5,326,328 | A | * | 7/1994 | Robinson | 472/136 |
| 5,697,851 | A | * | 12/1997 | Delgado | 472/116 |
| 5,816,980 | A | | 10/1998 | Myszka et al. | 482/35 |
| 6,361,445 | B1 | * | 3/2002 | Zeilinger | 472/117 |
| 6,527,645 | B1 | * | 3/2003 | Cline | 472/116 |

* cited by examiner

*Primary Examiner*—K. T. Nguyen
(74) *Attorney, Agent, or Firm*—Dennison, Schultz, Dougherty & MacDonald

(57) ABSTRACT

An arrangement for a playground for children is embodied as a internally hollow object, preferably of synthetic material, which can have the shape of a mountain top with a circumferential edge (2) at the bottom, which rests on the ground. The object (1) is embodied with windows (3) and with one or more doorways (4), and the internal hollow space constitutes a playhouse. The upper surface of the object (1) is embodied with one or more chutes (6) and with a flight of steps (7). The object (1) is held solidly to the ground surface by a vertical mast (11), e.g. of steel, which is carried through a hole (12) in the top of the object (1) and secured in the ground in a foundation block (13), and at its upper end has a free height (h) above the top of the object (1). The mast (11) can be supplemented with other play ground equipment, such as a frame for a swing (18) and a rope (19) for a ropeway. The arrangement is simple of construction and consequently cheap to produce.

5 Claims, 4 Drawing Sheets

ARRANGEMENT FOR A PLAYGROUND FOR CHILDREN

BACKGROUND OF THE INVENTION

The present invention relates to a playground for children, which comprises a playhouse, a chute and a flight of steps.

Such an arrangement is known from U.S. Pat. No. 5,816,980.

This known arrangement consists of a playhouse section, a tower section and of a connecting or tunnel section. The section comprising the playhouse and the tower is embodied with a number of cut-outs, which arrangement—among other things—enables the joining of the two sections and the attachment of chutes.

This known arrangement is complicated to erect and therefore expensive to produce.

SUMMARY OF THE INVENTION

It is a purpose of the present invention to describe an arrangement of the said kind, which is considerably more simple in its embodiment and consequently cheaper to produce.

This is achieved by embodying the arrangement as an internally hollow object, preferably of a synthetic material which, for instance, can be given the shape of a mountain top with a circumferential edge at the bottom, which is mainly in one plane, and which rests on the ground. The object is embodied with windows and one or more doorways and the internal hollow space constitutes the playhouse. A chute and a flight of steps are embodied in the upper side of the object, and there are means to secure the object to the surface of the ground.

In a further embodiment, the object is made of glass fibre reinforced polyester or epoxy, which is cast over an internal mold, whereby a thin shell is produced, which internal mold is cast over a model of the finished object to which has been applied a parting agent.

In another embodiment, walking areas outside the chute are embodied with a skid proof surface, which can be achieved by making the upper side of the model smooth at the areas where the object is to be smooth—preferably a chute—and giving all other areas a skid proof surface.

In another embodiment, special means are provided for the attachment of an arrangement according to the invention to the surface of the ground, so that it can withstand influences, especially wind pressure.

A further embodiment involves supplementary use of a holding device such as a mast for an arrangement according to the invention.

BRIEF DESCRIPTION OF THE DRAWINGS

The invention is explained in detail below with reference to the drawing, in which.

DESCRIPTION OF THE PREFERRED EMBODIMENTS

Figure 1:
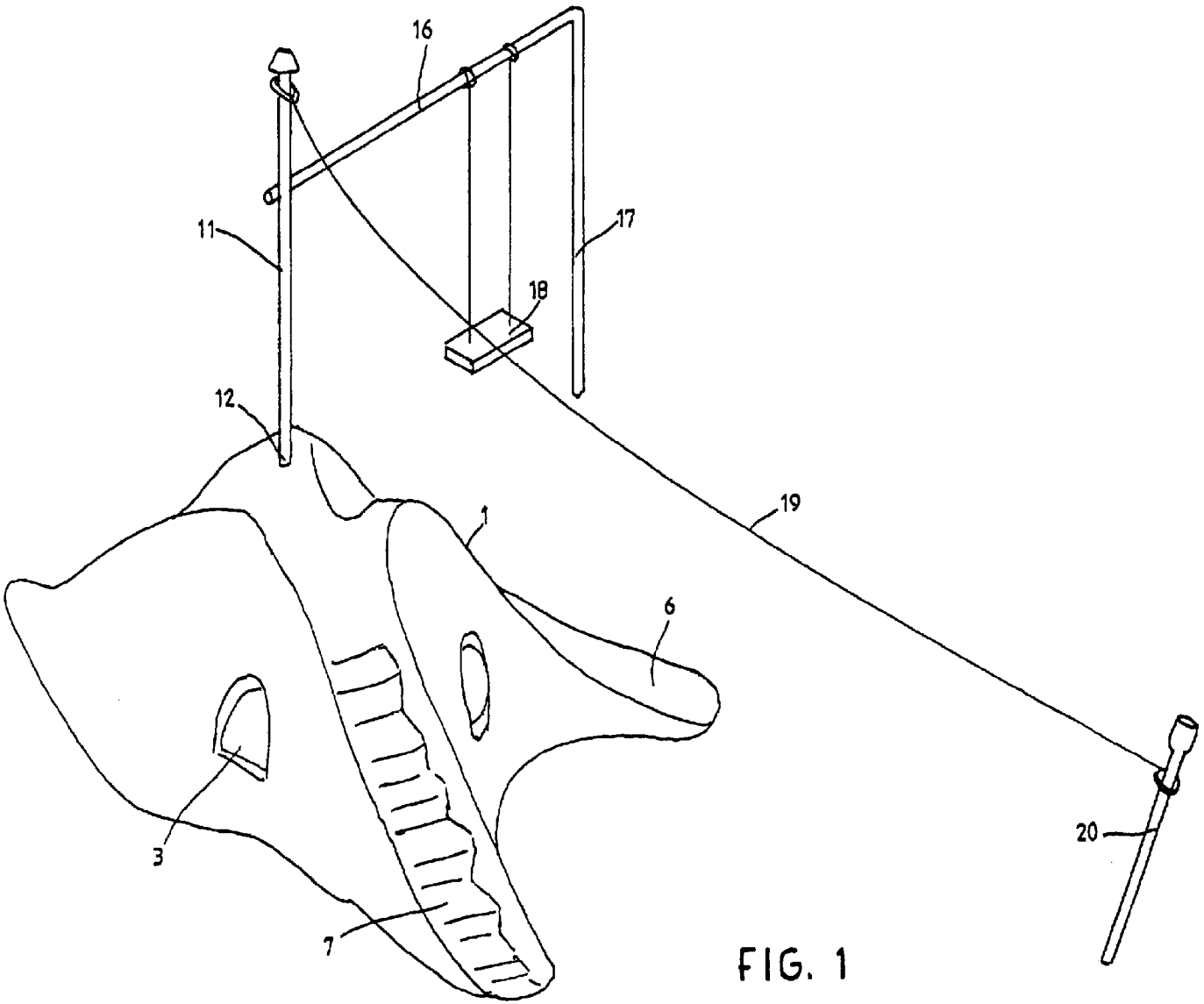
FIG. 1 is a perspective view of an arrangement according to the invention.
Figure 2:
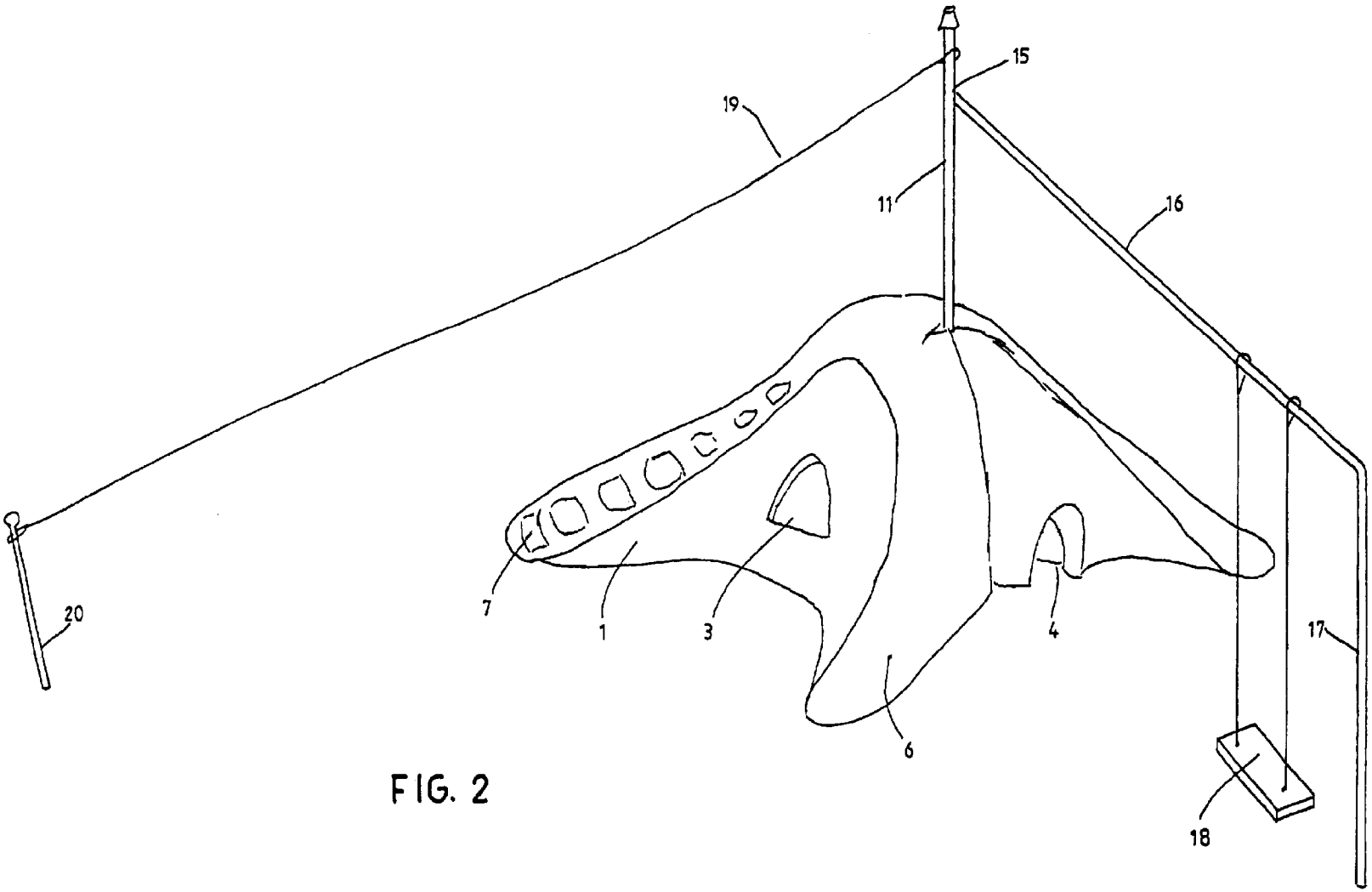
FIG. 2 shows an illustration corresponding to the one in FIG. 1 seen from another angle.
Figure 3:
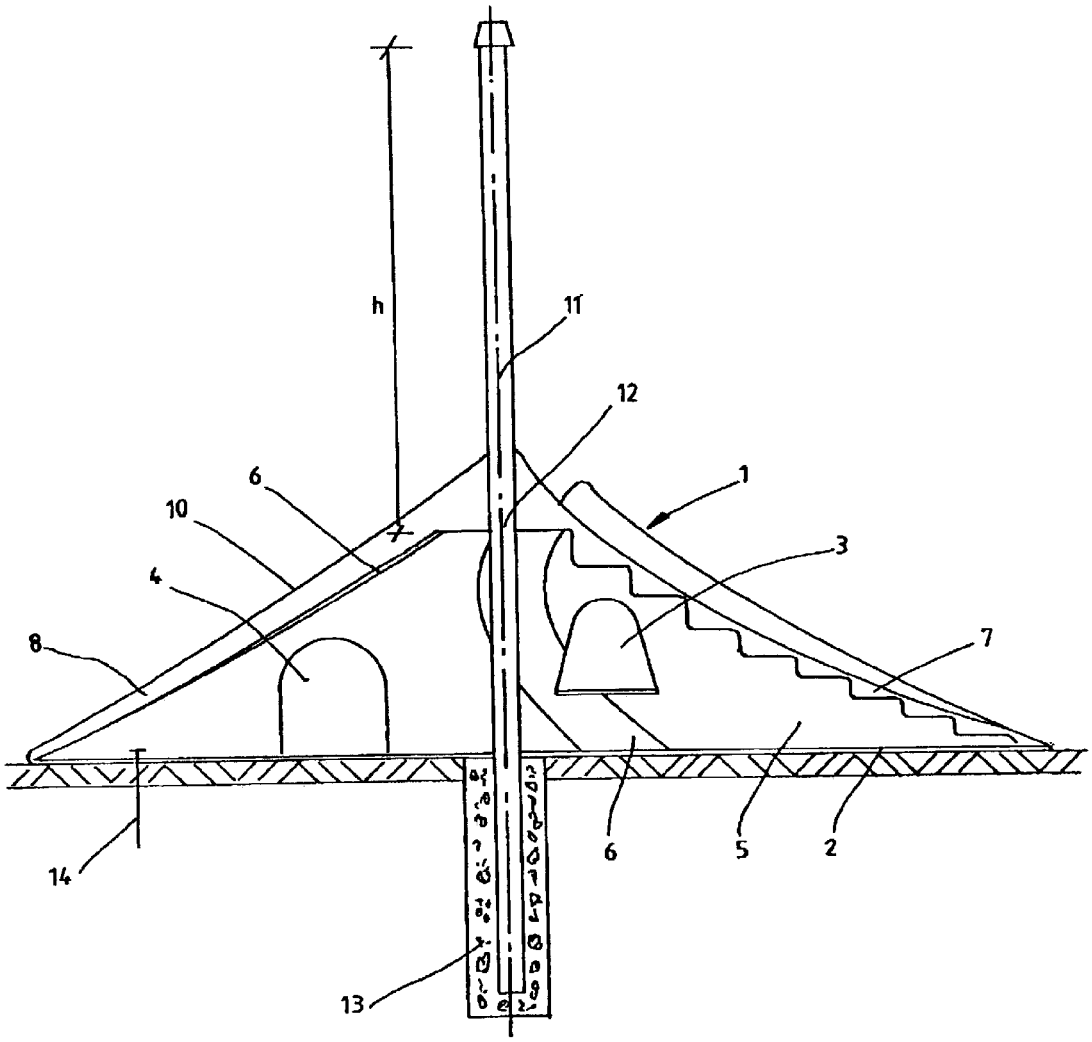
FIG. 3 shows a section through an arrangement according to the invention.
Figure 5:
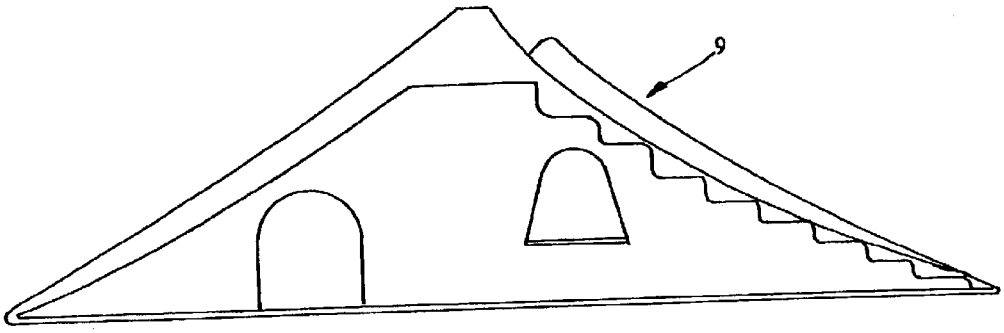
FIG. 5 shows an internal mold for the production of an object for an arrangement according to the invention.
Figure 4:
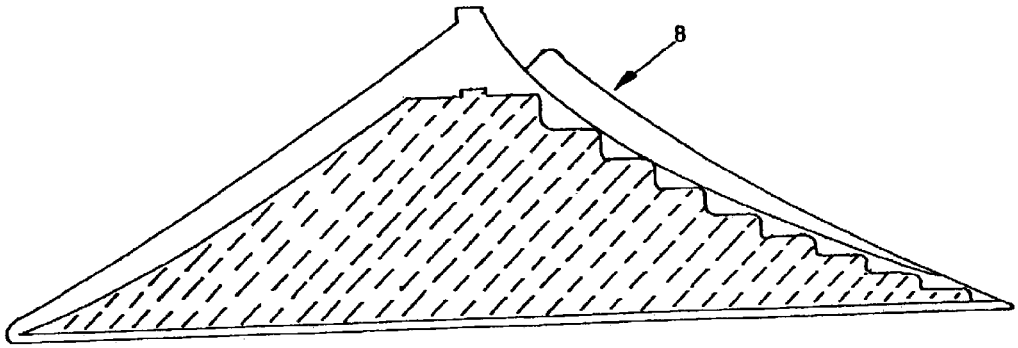
FIG. 4 shows a model for the production of an internal mold.

As shown in the drawings, an arrangement according to the invention is embodied as an internally hollow object 1, which is preferably produced of a synthetic material. The object can have the shape of a mountain top and have a circumferential edge 2 at the bottom, which in the main is in one plane and rests on the surface of the ground.

The object 1 is embodied with windows 3 and with one or more doorways 4. The internal hollow space 5 constitutes a playhouse. The top side surface of the object 1 is embodied with one or more chutes 6 and with one or more flights of steps 7, and one of the sides can be embodied as a climbing wall incorporating hand and foot holds.

The object 1 can be made of glass fiber reinforced polyester or of epoxy, which is cast over an internal mold 9, which is cast over a model 8 of the finished object 1, and which is given a parting agent. The internal mold 9 is embodied with not shown supporting organs. The final product is a thin shell 10.

Walking areas outside a chute 6 can be embodied with a skid proof surface, which can be produced by giving the top surface of the model 8 a smooth finish at the places where the object 1 is to be smooth—as at the chutes 6—and skid proof all the other places.

As the object 1 is a light construction it is necessary to attach it to the ground surface so that it can withstand influences from wind pressure.

To keep the object 1 in its place, a vertical or approximately vertical mast 11 can be used, which can be made of steel, aluminum or glass fiber, and which is carried through hole 12 at the top of the object 1 and secured in the ground, for instance in a foundation block 13. To prevent the object 1 from turning around the mast 11 the object can—if necessary—be further secured by one or more anchors 14, which can be carried through openings along the edge 2 of the object 1, and which are rammed down into the ground.

As shown, the mast 11 has at its upper end a free height h above the top of the object 1. At its upper end, the mast 11 can be attached to one end 15 of a horizontal bar 16, whose other end is attached to a vertical post 17. This combination results in a frame for one or more swings 18. There can furthermore be a rope 19 attached to the upper end of the mast 11. The rope 19 is attached at its other end to a support, which can be a pole 20, which is rammed down into the ground. This then constitutes an aerial ropeway. The bar 16 and the rope 19 serve as additional stabilization of the mast 11.

What is claimed is:

1. An arrangement for a playground for children, comprising:

an internally hollow object confining a hollow space for playing inside and a bottom portion, a circumferential edge bounding said bottom portion and for resting on the ground, said internally hollow object further comprising a thin shell configured as a mountain top, at least one chute extending from a top of said object to a bottom thereof and integral with said shell, at least one flight of steps extending from the top of said object to the bottom thereof and integral with said shell, a holding means extending from said top to beyond said bottom for inserting into the ground, and a plurality of securing means for anchoring and securing said object to the ground.

2. Arrangement according to claim 1, characterized by the fact that the object (1) is made of glass fibre reinforced polyester or epoxy, which is cast over an internal mold (9) whereby a thin shell (10) is produced, which internal mold (9) is cast over a model of the finished object (1), to which has been applied a parting agent.

3. Arrangement according to claim 1, characterized by the fact that walking areas outside the chute (6) are embodied with a skid proof surface, which can be achieved by making the upper side of a model (8) smooth at the areas, where the object (1) has a chute with a smooth surface, and giving all other areas a skid proof surface.

4. Arrangement according to claim 1, characterized by the fact that the holding means (11,14) comprise a vertical or approximately vertical post or mast (11), which is carried through a hole (12) at the top of the object (1) and is secured to the ground in a foundation block (13), and of one or more anchors (14) carried through openings along the edge (2) and rammed down into the ground.

5. Arrangement according to claim 4, characterized by the fact that the top of the mast (11) has a free height (h) above the top of the object (1), that a horizontal bar (16) is secured to the mast (11) at one end (15) and at the other end is attached to a vertical post (17) which is rammed into or in other ways held solidly in the ground, whereby a frame is produced for a swing (18), and that furthermore a rope being attachable to the upper end of the mast (11) be attached a rope (19), which at its other end is fastened to a post (20), which is secured in the ground, thus constituting a ropeway.

* * * * *